United States Patent [19]

Stevenson et al.

[11] 4,446,990

[45] May 8, 1984

[54] SELF-DEFENSE SPRAY DEVICE

[75] Inventors: David J. Stevenson, 36 Sandpiper Rd., Enfield, Conn. 06082; Robert E. Domian, Somers, Conn.

[73] Assignee: David J. Stevenson, Enfield, Conn.

[21] Appl. No.: 373,712

[22] Filed: Apr. 3, 1982

[51] Int. Cl.[3] ..... B67B 7/28

[52] U.S. Cl. ..... 222/82; 222/83.5; 222/398; 222/399; 222/630; 222/637

[58] Field of Search ..... 222/80, 81, 82, 83, 222/175, 394, 398, 399, 405, 630, 635, 637, 5, 83.5, 88

[56] References Cited

U.S. PATENT DOCUMENTS

| | | | |
|---|---|---|---|
| 2,605,763 | 8/1952 | Smoot | 222/82 |
| 3,119,561 | 1/1964 | Wilson | 222/399 |
| 3,228,565 | 1/1966 | Stanzel | 222/82 |
| 3,266,668 | 8/1966 | Davis | 222/5 |

*Primary Examiner*—Joseph J. Rolla
*Assistant Examiner*—Charles C. Compton

[57] ABSTRACT

A device for spraying a noxious powder includes a housing for a $CO_2$ cartridge, and a moveable barrel which carries a firing pin by which the cartridge can be punctured to explosively release the gas. The barrel has a nozzle at its outer end, and contains the noxious powder in a chamber defined between the barrel and the firing pin. When the barrel is released from an outwardly extended position it is thrust by a spring against the rupturable end of the cartridge, thereby releasing the gas which in turn propels the active agent through the nozzle and toward the assailant at whom it is aimed. Generally, a powdered tear gas will be employed in the device.

22 Claims, 3 Drawing Figures

SELF-DEFENSE SPRAY DEVICE

BACKGROUND OF THE INVENTION

There has long been a recognized need for means by which individuals can arm themselves against personal attack, using less than deadly repulsive force. To satisfy that need, there have previously been proposed hand-held devices containing a noxious liquid or powder, which can be discharged toward the assailant to foil his attempt. As indicated in U.S. Pat. Nos. 1,885,126 to Medlock; 1,994,294 and 1,994,295 to Williams, Jr.; 2,001,405 to Abbott; 3,084,466 to Duncan III; 3,820,607 to Miley; and 4,062,473 to Fegley, such devices have typically utilized shells or cartridges loaded with the noxious substance and having an associated explosive cap or charge, which can be detonated by a firing pin of the device to expel the material. Not only does this, of course, presuppose the availability of suitably loaded shells, but moreover, the use of an explosive propellant entails an obvious element of danger to the individuals utilizing them, and they require rather heavy construction to minimize such risk; at the very least, care must be exercised to load the shell with just the right amount of the explosive to ensure effective, and yet safe, operation.

Alternative propellant sources are also known, including canisters and cylinders of gas under pressure (i.e., the so-called "$CO_2$ cartridges"). The latter are commonly used to power BB guns and the like, as well for a variety of other applications, including the inflation of life jackets, as shown in Mackal U.S. Pat. Nos. 4,223,805, 4,260,075 and 4,267,944. Canisters of gas under pressure have also been employed for a variety of purposes, such as to inflate tires and to unclog drains, the latter being described in Nakane U. S. Pat. No. 3,879,771. The prior art devices utilizing all of such gas sources for propellant purposes seem invariably to rely upon a controlled, incremental release of the pressurized gas for ultimate discharge. As far as is known, such means has not heretofore been utilized in connection with a self-defense spray device.

In an endeavor to satisfy the foregoing need, tear gas bomb products are offered commercially under the trade designation "MACE". Since, however, a liquid propellant is employed therein, the active ingredient must be diluted to about a one percent concentration, rendering such products of only limited value as a means for quickly and completely disabling the would-be attacker.

Accordingly, it is a primary object of the present invention to provide a novel self-defense device or spray gun that is of very small size and self-contained, and is highly effective, safe, relatively free from legal constraints, reliable and convenient to employ.

It is also an object of the invention to provide such a device which is of very uncomplicated construction, consisting of relatively few parts of simple design, which can therefore be manufactured readily and quite inexpensively.

Another object of the invention is to provide a self-defense device of the foregoing nature which utilizes no shells or cartridges, and which therefore is loaded with the active substance with great facility and at minimum cost.

Yet another and more specific object of the invention, is to provide a novel device having the foregoing features and advantages, which is especially well-suited for the spraying of a noxious powder, and is therefore capable of instantaneously subjecting the attacker to a large and very effective dose of the active agent.

SUMMARY OF THE INVENTION

It has now been found that the foregoing and related objects of the present invention are readily attained in a device comprising a body including two parts that are telescopically interengaged for sliding movement between relatively extended and retracted positions. One of the parts has a spray nozzle adjacent its outer end and puncturing means adjacent its inner end, with a containment chamber for the active agent defined therebetween. The other part of the body defines a chamber for holding a gas cartridge in an inwardly directed position, for rupture by the puncturing means of the first body part in the retracted position thereof. The device also includes means for disengageably retaining the parts in their extended position, and means for urging the parts toward the retracted position. Thus, with the parts in the extended position, release of the retaining means will thrust them together, causing the puncturing means of the one part to pierce and thereby explosively discharge a gas cartridge held in the other. The rapidly expanding gas released from the cartridge will, in turn, eject the active agent from the containment chamber outwardly through the nozzle and toward the subject.

Generally, the parts of the body will be of tubular construction, and usually of circular cross-section. In the preferred embodiments, the "one" part will comprise a barrel and the "other" part will comprise a housing, the barrel being slideably mounted within the housing for movement from the extended position to the retracted position. The retaining means will desirably comprise a latch mechanism mounted upon the housing for manual access and operation. To coact therewith the barrel will desirably have means for cooperatively engaging the latch mechanism in either of two positions, one being the relatively extended position and the other being an intermediate, less-extended position spaced therefrom.

The puncturing means will normally comprise a firing pin mounted within the inner end of the barrel, and will be of perforate construction so as to permit the expanding gas to pass therethrough and into the containment chamber; more particularly, the firing pin will advantageously be formed with a mulitplicity of gas ports which open in a regular pattern on one of its faces. By disposing a point of pyramidal configuration centrally thereof on the same face, the flow of gas can be directed into the ports in a most effective maner. Generally, the perforations of the firing pin will be closed by means that is readily displaced or ruptured (e.g., a tissue membrane) under the pressure of the expanding gas discharged from the cartridge, thereby confining the active agent within the internal chamber of the barrel. To close the opposite end of the chamber, the device may additionally include a plug mounted within the nozzle of the barrel, which is readily displaceable under the pressure of the expanding gas.

In most instances, the "other" body part or housing of the device will be adapted to hold a gas cartridge having a reduced neck portion at one end, through which axial penetration can be effected for release of the gas. In such an instance a collar may be disposed at an intermediate location within the housing, the collar being dimensioned, configured and constructed to span the chamber and to receive the reduced neck portion of the gas cartridge therethrough in substantially sealed engagement. This will effectively confine the expanding gas released from the cylinder to the portion of the chamber lying inwardly of the collar, thereby utilizing the available volume of gas to greatest advantage. A plug will generally be disengageably mounted within the other end of the housing to close the chamber and to maintain the gas cartridge in position, removal of the plug permitting substantial disassembly of the body parts. As will be appreciated, when loaded for use the chamber of the barrel will contain a substance that is capable of immobilizing or incapacitating an attacker, and most advantageously the substance will be a noxious powder, especially a lacrymator.

DETAILED DESCRIPTION OF THE ILLUSTRATED EMBODIMENT

Figure 1:
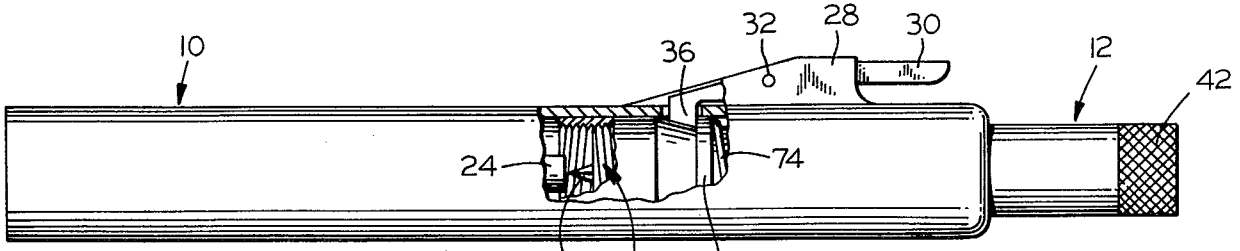
FIG. 1 is an elevational view of a device embodying the present invention with the barrel in its safety position, a portion of the housing being broken away to illustrate the construction of the cooperating parts of the latching mechanism.
Figure 2:
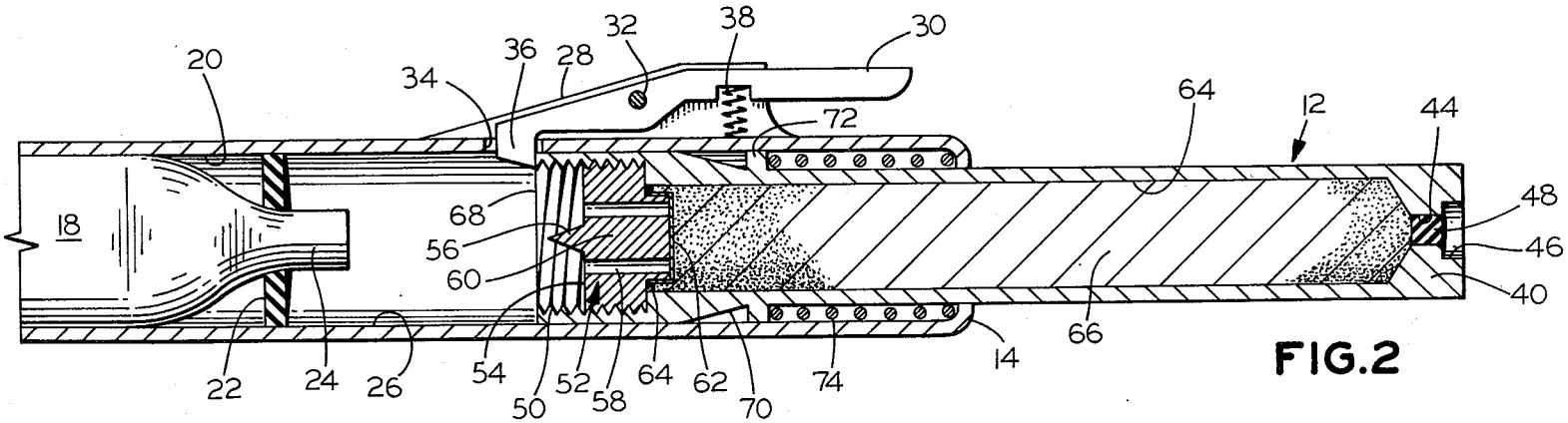
FIG. 2 is a fragmentary vertical cross-sectional view of the device of FIG. 1, drawn to an enlarged scale and showing the barrel in its cocked position.

Turning now in detail to the appended drawings, therein illustrated is a self-defense spray gun device embodying the present invention and consisting of a housing, generally designated by the numeral 10, and a barrel, generally designated by the numeral 12; the barrel 12 is telescopically mounted for slideable movement within the housing 10. The latter has an inwardly curved circumferential lip 14 at its forward end, and an internally threaded portion 16 at the opposite end. A $CO_2$ cartridge, generally designated by the numeral 18, is inserted forwardly into the chamber 20 of the housing 10, with a collar 22 of a resilient material placed about its neck portion 24. As will be appreciated, the collar 22 effectively defines a reduced volume compartment 26 within the chamber 20, within which the pressure developed upon release of the gas from the cylinder 18 will be maintained at a relatively high level to thereby maximize its effect.

The body 10 has a pair of upstanding ears 28 affixed thereto, which define a channel within which the latch 30 is mounted by a pin 32, which extends through the latch 30 and the ears 28. The housing 10 has an aperture 34 through which the dog or nose portion 36 of the latch 30 normally projects, under the biasing force of the coil spring 38.

The forward end portion 40 of the barrel 12 is knurled at 42 to facilite manual gripping, and it is internally configured to provide a nozzle structure comprised of an aperture 44 of relatively small cross-section and an enlarged outer bore portion 46; the displaceable plug 48 is frictionally mounted within the aperture 44. The rearward end of the barrel 12 has an internally threaded portion 50 within which a firing pin, generally designated by the numeral 52, is threadably engaged. A pyramidal point 56 is formed on the outer face 54 of the pin 52 in a central location, and four ports 58 extend through the pin; the ports open on the face 54 in general alignment with the faces of the point 56 to promote the flow of gas released from the cylinder 18 into the compartment 26.

The opposite end 60 of the firing pin 52 is of somewhat reduced cross section, and has engaged thereon a sealing cap 62 provided by a paper membrane, which is held in place by an elastic ring 64 extending circumferentially thereabout. The cap 62 cooperates with the plug 48 in the nozzle aperture 44 to define a closed chamber 64 within which the active agent 66 can be confined. As will be understood, because the membrane 62 is fabricated from a readily ruptured material, the pressurized gas from the cartridge 18 will pass readily therethrough and into the chamber 64. Use of the membrane 62 and plug 48 permit the chamber 64 to be filled from a bulk supply of the repellant material, effectively retaining it therein until the device is fired.

The rearward end of the barrel 12 is externally configured to cooperate with the latch 30 to retain the barrel 12 in either its armed or its safety position. To enable the barrel to be set in its fully extended or cocked position, its rearmost edge 68 provides an annular surface on which the nose portion or locking dog 36 of the latch 30 can securely engage. The forwardly spaced frusto-conical portion defines a circumferential notch 70 to receive the locking dog 36, thus permitting the barrel to be set in a less fully extended safety position. One end of a coil spring 74 bears upon the narrow circumferential collar 72, and the opposite end is trapped behind the inwardly deformed lip 14, causing the spring to exert a rearward bias upon the barrel 12.

Figure 3:
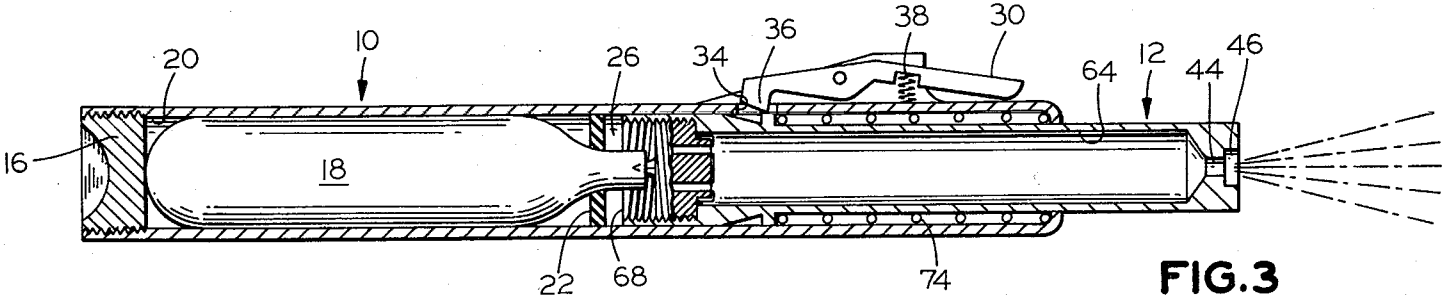
FIG. 3 is a similar view, drawn to the scale of FIG. 1, and showing the fired position.

Normally, the device will be carried by the individual with the barrel in its safety position; that is, with the locking dog 36 of the latch 30 engaged within the circumferential notch 70, as shown in FIG. 1. Upon apprehension of danger, the individual need merely grasp the knurled end 42 of the barrel, and withdraw it further from the housing 10 until the dog 36 catches upon the annular surface 68, to arm the device. It can then be fired merely by depressing the latch 30 against the upward force of the spring 38, releasing the barrel 12 and permitting the spring 74 to thrust it rearwardly into the compartment 26. This will cause the point 56 of the firing pin 52 to axially pierce the neck portion 24 of the cartridge 18, in turn permitting explosive release of the carbon dioxide gas contained therewithin. The gas from the cartridge will pass through the ports 58 in the firing pin, and then into the chamber 64 of the barrel 12. Under the pressure developed, the substance 66 within the chamber 64 will be propelled through the nozzle aperture 44, displacing the plug 48 in the process. The user will, of course, direct the spray of material toward the attacker to foil, or at least retard, his attempt. The discharged condition of the device is shown in FIG. 3.

Reloading is a simple matter, and is readily achieved by first unscrewing the threaded plug 16, enabling removal of the cartridge 18 and withdrawal of the entire barrel assembly 12 through the outer end of the housing 10 (the latch 30 being held in its depressed "firing" position to permit such disassembly). A replacement plug 48 can then be inserted within the inner aperture 44 of the barrel, following which a fresh charge of the active material 66 can be poured into the chamber 64. After applying a new membrane cap 62, the firing pin 52 will be replaced within the threaded recess 50, and the barrel and housing will be reassembled. Then a fresh $CO_2$ cartridge 18 (with a sealing collar 22 in place on its reduced neck portion 24) will be inserted into the chamber 20, with replacement of the plug 16 completing the reloading operation.

The construction illustrated will be facile and relatively inexpensive to manufacture, and highly convenient, reliable and effective in use; therefore, it is presently regarded to constitute the best mode for carrying out the invention. Nevertheless, it will be appreciated that variations can be introduced without departing from the concepts involved. For example, the parts of the body need not be tubular and need not be of circular cross section, so long as they are slideable with respect to one another to effect discharge of the $CO_2$ cartridge and spraying of the contained material in the manner described. It will also be appreciated that the part to be held by the user need not be that which contains the gas cartridge, but may rather be the container for the active agent, in which event operation would occur with the moving part being thrust forwardly, rather than rearwardly as in the embodiment illustrated. The form of the plugs or sealing members utilized may also vary considerably, as may be the particular configuration and arrangement or placement of the firing pin. Similarly, a wide variety of latching mechanisms may be employed in the construction of the device, and variations will readily occur to those skilled in the art.

While the materials of construction are not of crucial importance, in most instances metal parts will predominate, for obvious reasons of safety and durability. This will, of course, be particularly so with respect to the firing pin, since the point provided thereon must remain sufficiently sharp to completely puncture the end of the cartridge, to achieve substantially instantaneous release of the entire gas supply. Perhaps it should be emphasized here that the present device operates with the $CO_2$ cartridge being discharged completely, and with virtually all of the gas being expelled through the containment chamber of the barrel in a single surge. This is believed to be in contrast to the manner in which such gas cartridges have previously been used for propellant purposes, wherein the ultimate discharge occurs in controlled increments, albeit that initial release of the gas from the cartridge (e.g., into a reservoir within the device) may occur explosively.

The nature of the substance utilized to repel the attacker may also very widely, and may be of either a liquid or particulate nature, although the latter is most preferred from the standpoints of convenience (e.g., facility of loading, ease of handling and storage, and the like) and effectiveness. While various such substances may be used, powdered tear gas (e.g., alpha-chloroacetophenone) is highly effective, is readily available and is relatively inexpensive; therefore, such a lacrymator will normally constitute the active agent of first choice. Alternatively, irritating inhalants (so-called "sternutators") such as diphenyl chloroarsine, can be employed to good effect. Although one of the outstanding advantages of the present device is that it permits such chemical agents to be utilized at full strength levels, it may be necessary or desirable to dilute them, for which purpose an "inert" powder (such as sodium bicarbonate) can be utilized in any desired proportion. Indeed, such a diluent can, in some instances, be used by itself, relying upon the fine powdery character of the material to cause choking and coughing of the assailant, and thereby to deter his attempt.

Thus, it can be seen that the present invention provides a novel self-defense device that is of very small size and is self-contained, and is highly effective, safe, reliable and convenient to employ. The device is of very uncomplicated construction, consisting of relatively few parts of simple design, and it can therefore be manufactured readily and quite inexpensively. Since no shells or cartridges need be utilized, loading with the active substance can be accomplished with great facility and at minimum cost, albeit that pre-loaded barrel assemblies may advantageously be provided in certain instances. Moreover, sale and use are not subject to the legal constraints that are placed upon explosive devices. The present unit is especially well-suited for the spraying of a noxious powder, and is therefore capable of instantaneously subjecting the attacker to a large and very effective dose of the active agent.

Having thus described the invention, what is claimed is:

1. In a device for spraying an incapacitating substance, the combination comprising: a body including two parts that are telescopically interengaged for sliding movement between relatively extended and retracted positions, one of said parts having a spray nozzle adjacent its outer end and puncturing means adjacent its inner end with an incapacitating substance containment chamber defined therebetween, the other of said parts defining a chamber for holding a gas cartridge in an inwardly directed position for rupture by said puncturing means in said retracted position of said parts; means for disengageably retaining said parts in said extended position; and biasing means for forcing said parts toward said retracted position, whereby upon release of said retaining means said puncturing means of said one part can explosively dischage a gas cartridge held in said other part, the expanding gas thereby released from the cartridge in turn ejecting the incapacitating substance from said containment chamber through said nozzle.

2. The device of claim 1 wherein said parts are of tubular construction and of generally circular cross section.

3. The device of claim 1 wherein said parts are of tubular construction and said one part comprises a barrel and said other part comprises a housing, said barrel being slideably mounted within said housing for movement from said extended position to said retracted position to thrust said puncturing means against the end of a gas cylinder contained within said housing.

4. The device of claim 3 wherein said retaining means comprises a latch mechanism mounted upon said housing for manual access and operation.

5. The device of claim 4 wherein said barrel has means thereon for cooperatively engaging said latch mechanism in either of two positions, one of said positions being said relatively extended position of said barrel and the other being a less extended safety position intermediate said extended and retracted positions thereof.

6. The device of claim wherein said puncturing means comprises a firing pin mounted at the inner end of said one part, said firing pin being of perforate construction so as to permit the expanding gas to pass therethrough into said containment chamber.

7. The device of claim 6 wherein said firing pin has a multiplicity of gas ports therethrough opening in a regular pattern on one face thereof, and a point of pyramidal configuration disposed on said one face centrally of said port openings and configured to promote the flow of gas thereinto.

8. The device of claim 6 additionally including means for closing the perforations of said firing pin, said means being readily ruptured or displaced under the pressure of the expanding gas discharged from the cartridge.

9. The device of claim 8 wherein said closing means comprises a membrane disposed upon said firing pin.

10. The device of claim 1 additionally including a plug disengageably mounted within said nozzle, said plug being adapted for ready displacement under the pressure of the expanding gas discharged from the ruptured cartridge.

11. The device of claim 1 wherein said other body part is adapted to hold a gas cylinder that has a reduced neck portion at one end and is adapted for rupture by axial penetration within said neck portion.

12. The device of claim 11 additionally including a collar disposed at an intermediate location within said chamber of said other body part, said collar being dimensioned, configured and constructed to span said chamber and to receive the reduced neck portion of the gas cylinder therthrough in sealing engagement, whereby the expanding gas released from the cylinder will be substantially confined within the portion of said chamber that lies inwardly of said collar.

13. The device of claim 11 additionally including a plug disengageably mounted within the outer end of said other body part, said end plug being adapted to close chamber thereof and to maintain the gas cartridge in position therewithin, removal of said end plug permitting substantial disassembly of said body parts.

14. The device of claim 1 additionally including a noxious substance within said containment chamber.

15. The device of claim 14 wherein said sustance is in powder form.

16. The device of claim 15 wherein said powder is a lacrymator.

17. In a device for spraying an incapacitating substance, the combination comprising: a body including a housing and a barrel telescopically received therein for sliding movement between a relatively extended position and a retracted position, said barrel having a spray nozzle adjacent its outer end and a firing pin adjacent its inner end with an incapacitating substance containment chamber defined therebetween, said housing having defined therein a chamber for holding a gas cartridge in an inwardly directed position for rupture by said firing pin in said retracted position of said barrel; latching means for disengageably retaining said barrel in said extended position; biasing means for forcing said barrel toward said retracted position; an incapacitating substance contained within said chamber of said barrel; and a gas cartridge held within said chamber of said housing; whereby upon release of said latching means said firing pin can explosively discharge said gas cartridge, the expanding gas thereby released in turn ejecting the incapacitating substance from said containment chamber of said barrel through said nozzle.

18. The device of claim 17 wherein said latching means is affixed to said housing, and wherein said barrel has first and second elements thereon for retaining said barrel in a fully extended cocked position and in a partially extended safety position, respectively.

19. The device of claim 18 wherein said latching means comprises a lever with a locking dog on one end dimensioned and configured to engage said retaining elements of said barrel, and means for biasing said dog inwardly, said second element comprising a circumferential notch defined by a surface that tapers forwardly to an annular surface extending perpendicularly to the axis of said barrel.

20. A barrel assembly adapted for use in a device for spraying an incapacitatig substance, comprising: a tubular body; spray nozzle means at one end of said body; perforate means for puncturing a gas cartridge, at the opposite end of said body; means for disengageably or rupturably closing said spray nozzle means and said puncturing means, to define a chamber therebetween within said body; and a charge of an incapacitating substance within said chamber, whereby gas released from a cartridge can, upon disengagement or rupture of said closing means, pass through the perforations of said puncturing means to propel said charge from said chamber outwardly through said nozzle.

21. The assembly of claim 29 wherein said closing means comprises a disengageable plug within said nozzle means, and a membrane disposed upon said puncturing means over the perforations therethrough.

22. The assembly of claim 20 wherein said body is adapted to be telescopically mounted within a housing for holding a gas cylinder, and wherein said body has means thereon for cooperating with latching means on the housing to disengageably lock said body in at least one position of extension relative thereto.

* * * * *